US011432088B2

(12) United States Patent
Hansen

(10) Patent No.: US 11,432,088 B2
(45) Date of Patent: Aug. 30, 2022

(54) METHOD AND MANIKIN FOR ELECTROACOUSTIC SIMULATION

(71) Applicant: GN Audio A/S, Ballerup (DK)

(72) Inventor: Helge Lykke Hansen, Ballerup (DK)

(73) Assignee: GN Audio A/S, Ballerup (DK)

( * ) Notice: Subject to any disclaimer, the term of this patent is extended or adjusted under 35 U.S.C. 154(b) by 0 days.

(21) Appl. No.: 17/212,103

(22) Filed: Mar. 25, 2021

(65) Prior Publication Data

US 2021/0329394 A1 Oct. 21, 2021

(30) Foreign Application Priority Data

Apr. 16, 2020 (DK) ..... PA202070238

(51) Int. Cl.

| | |
|---|---|
| ***H04R 29/00*** | (2006.01) |
| ***H04R 1/02*** | (2006.01) |
| ***H04R 1/08*** | (2006.01) |
| ***H04R 7/12*** | (2006.01) |
| ***H04R 7/18*** | (2006.01) |
| ***H04R 9/02*** | (2006.01) |
| ***H04R 9/06*** | (2006.01) |

(52) U.S. Cl.

CPC ..... *H04R 29/001* (2013.01); *H04R 1/025* (2013.01); *H04R 1/08* (2013.01); *H04R 7/12* (2013.01); *H04R 7/18* (2013.01); *H04R 9/025* (2013.01); *H04R 9/06* (2013.01)

(58) Field of Classification Search

CPC ..... H04R 29/001; H04R 1/025; H04R 1/08; H04R 7/12; H04R 7/18; H04R 9/025; H04R 9/06

See application file for complete search history.

(56) References Cited

U.S. PATENT DOCUMENTS 10,595,151 B1 * 3/2020 Chen ..... H04R 1/1008
2001/0025202 A1 9/2001 Trinkel (Continued)

FOREIGN PATENT DOCUMENTS

CN 103988485 A 8/2014
CN 104365120 A 2/2015

(Continued)

OTHER PUBLICATIONS

Intention to Grant issued in Danish Application No. PA 2020 70238, dated Feb. 2, 2021.

(Continued)

*Primary Examiner* — Andrew L Sniezek
(74) *Attorney, Agent, or Firm* — Hamre, Schumann, Mueller & Larson, P.C.

(57) ABSTRACT

An apparatus, comprising: a manikin with at least a head portion and an ear portion; wherein the head portion has an inner side and an outer side and accommodates a mouth simulator including an electro-acoustic transducer. Further, the apparatus comprises an electrodynamic vibrator with a vibrating rod wherein the vibrating rod is coupled to the manikin to exert a vibrating force at the head portion; and wherein the vibrating force induces vibration of the manikin at least at the ear portion. Thereby more realistic electroacoustic tests on devices under test such as such as headsets, headphones, earphones, hearing instruments and active hearing protectors can be performed.

13 Claims, 4 Drawing Sheets

(56) References Cited

U.S. PATENT DOCUMENTS

| | | | | |
|---|---|---|---|---|
| 2006/0126855 | A1 | 6/2006 | Geiger et al. | |
| 2008/0112581 | A1* | 5/2008 | Kim | H04R 1/1075 381/151 |
| 2015/0128708 | A1 | 5/2015 | Ikeda | |
| 2015/0341733 | A1 | 11/2015 | Ikeda | |
| 2018/0035225 | A1 | 2/2018 | Inagaki | |

FOREIGN PATENT DOCUMENTS

| | | | |
|---|---|---|---|
| CN | 108702581 | A | 10/2018 |
| CN | 111405450 | A | 7/2020 |
| JP | 2018142769 | A | 9/2018 |

OTHER PUBLICATIONS

Office Action issued in Danish Application No. PA 2020 70238, dated Oct. 7, 2020.

The extended European search report issued in European Application No. 21167337.1, dated Sep. 27, 2021, 7 pages provided.

Schroeter et al., "The use of acoustical test fixtures for the measurement of hearing protector attenuation. Part I: review of previous work and the design of an improved test fixture a)", The journal of the acoustical society of America, American Institute of Physics for the acoustical society of America, New York, NY, US, vol. 79, No. 4, Apr. 1, 1986, pp. 1065-1081.

* cited by examiner

METHOD AND MANIKIN FOR ELECTROACOUSTIC SIMULATION

For the purpose of electroacoustic tests of electronic devices such as telephone handsets, headsets, headphones, earphones, audio conference devices, hearing instruments, hearing protectors etc., specialized manikins with built-in ear simulator and mouth simulators exist.

The specialized manikins provide a more realistic reproduction of the acoustic properties of, typically, an average adult human head; sometimes including a torso.

As an example, Head and Torso Simulator (HATS) Type 4128C, manufactured by Brüel & Kjaar, is a manikin with built-in ear and mouth simulators to provide a realistic reproduction of the acoustic properties of an average adult human head and torso. It is designed to be used in-situ electroacoustic tests on, for example, telephone handsets, headsets, audio conference devices, microphones, headphones, hearing aids and hearing protectors.

However, it has been observed that the realistic reproduction of the acoustic properties can be further improved for the benefit of e.g. improving electronic devices including the above-mentioned electronic devices as a few examples.

SUMMARY

It is realized that the prior art manikins for electroacoustic tests, and in particular a mouth simulator in the manikin, is not suited to act to generate both of an acoustic signal through the mouth portion of the manikin and to generate a sufficient vibration amplitude at least at the ear portion of the manikin. There is therefore provided:

An apparatus, comprising:

a manikin (101) with at least a head portion (102) and an ear portion (107); wherein the head portion has an inner side and an outer side and accommodates a mouth simulator 104 including an electroacoustic transducer 105; and an electrodynamic vibrator 120 and a vibrating rod 121 coupled to the electrodynamic vibrator 120; wherein the vibrating rod is coupled to the manikin 101 to exert a vibrating force at the head portion 102; wherein the vibrating force induces vibration of the manikin at least at the ear portion 107.

An advantage of such an apparatus is that is can be used to perform more realistic electroacoustic tests on devices under test, for example, on devices under test such as headsets, headphones, earphones, hearing instruments and active hearing protectors. The apparatus enables a more realistic simulation of sound propagation from the mouth simulator to the ear portion by deliberately inducing vibration of the manikin, at least at the ear portion, in addition to the acoustic waves propagated in the air surrounding the head portion from the mouth simulator, via a mouth opening to the outside of an ear at the ear portion. In particular, the induced vibration may mimic so-called bone conducted sounds known from a being's head.

Thus, the electrodynamic vibrator and the vibrating rod interact electromagnetically to produce a magnetic force which induces a vibration at least at the ear portion of the manikin. The vibrating rod transfers vibration to the manikin.

In some aspects, the vibrating rod is coupled to the manikin to exert the vibrating force via the inner side of the head portion. Thus, the vibrating rod is not in the way for a device under test arranged at an ear of the manikin, or in an ear canal of the manikin or on an ear of the manikin. Also, the vibrating rod is thereby not in the way for sound waves traveling from the mouth simulator, through the mouth opening and to the ear portion.

In some other aspects, the head portion is exerted to vibrate via a coupling to the outer side of the head portion. The coupling to the outer side of the head portion is e.g. at a portion at or above the ear portion. In some aspects, the coupling includes a resilient member, e.g. a cushion, between the vibrating rod and the head portion. As a guiding principle for configuring the coupling in terms of position and stiffness (rigidity versus resilience), the amplitude and spectrum of vibrations at the ear portion of the manikin should resemble the amplitude and spectrum of vibrations at a human ear in response to a predetermined acoustic signal uttered through the mouth of the manikin and the mouth of the human, respectively. In particular, excessive vibrations can be avoided when the head portion is exerted to vibrate via a coupling to an inner side of the head portion.

The manikin may include an ear simulator including at least one microphone.

The ear simulator is accommodated inside the manikin e.g. coupled to an ear member or ear portion of the manikin. The manikin may be embodied, at least partially, by a shell construction. The shell construction may accommodate the mouth simulator and an ear simulator. The shell construction may include fixtures for fixation of the mouth simulator and the ear simulator. The shell construction forms a space, which may be made from a plastics material or a resin material. The shell construction may include a neck portion a downward opening and coupling means, e.g. a bayonet coupling, to connect with complementary coupling means, e.g. a complementary bayonet coupling. In some aspects, the electrodynamic vibrator is accommodated in a base which forms a platform for the manikin. In other aspects, the electrodynamic vibrator is accommodated in the manikin, e.g. the electrodynamic vibrator is accommodated in a head portion of the manikin. In some aspects, the ear simulator includes a microphone, which is a vibrational pick-up e.g. including an accelerometer.

In some examples, the manikin body is a TYPE 4128 HEAD AND TORSO SIMULATOR (HATS) manufactured by Brüel & Kjaar for in situ electroacoustic tests.

In some embodiments the apparatus comprises a first member 122 and a second member 123 which are magnetic and/or magnetisable; wherein the first member 122 is fixated on a downwardly facing face of the manikin or a member attached to the manikin; and wherein the second member 123 is fixated on a distal portion of the vibrating rod 111.

This enables attaching and detaching of the electrodynamic vibrator to and from the manikin without the use of tools and/or without requiring mechanical fixation. The first member and the second member are arranged to magnetically attract each other at least when the vibrating rod is arranged in proximity of the manikin about to engage with the manikin for transferring vibrations.

In some aspects the manikin includes a downwardly open neck portion through which the vibrating rod extends; wherein the neck portion of the manikin rests against a support accommodating the electrodynamic vibrator. At least in such embodiments it may be difficult to mechanically attach the vibrating member to the manikin. However, since the vibrating member can connect to the manikin using a magnetic attracting force between the first member and the second member, a secure and stable connection capable of transferring vibrations can be conveniently established.

In some embodiments, the magnetic force is sufficiently strong to keep the vibrating element in physical contact with the manikin body when the vibrating member is actively vibrated by the electrodynamic vibrator.

In some examples, the one or both of the first member and the second member includes a permanent magnet e.g. made from Neodymium (also known as NdFeB). In some examples one of the first member and the second member includes a metal plate e.g. a disk shaped metal plate and the other member includes a permanent magnet. One or both of the first member and the second member may be attached by glue to the vibrating rod. The vibrating rod may be made from a lighter material than metal, e.g. a plastics or resin based material such as a fibre reinforced resin material.

In some embodiments the apparatus comprises a resilient suspension element 201; 202; wherein the resilient suspension element 201; 202 enables a static axial movement of the vibrating rod 121 to accommodate at least some static offset between the manikin 102 and the electrodynamic vibrator 120.

This enables contact between the vibrating rod and the manikin despite of an offset e.g. due to production tolerances in the distance between the manikin and the electrodynamic vibrator or small inaccuracies in attachment between the manikin and the electrodynamic vibrator.

In particular, when the vibrating rod connect to the manikin using magnetic force, the resilient suspension element enables contact between the manikin and the vibrating member despite of production tolerances in the distance between the manikin and the electrodynamic vibrator or small inaccuracies in attachment between the manikin and the electrodynamic vibrator. When there is a distance, albeit a close distance, between the vibrating rod and the manikin, the resilient suspension element may be compliant under the magnetic attraction force to enable connection, and abutment, as soon as there is only a close distance between the vibrating rod and the manikin during attachment of the two.

Also, when visual inspection of the connection between manikin and the vibrating member is obscured, the resilient member enables reliable coupling.

In some embodiments, the electrodynamic vibrator 120 comprises a first permanent magnet 203; an air gap 204 and a first moving coil (205) fixated to the vibrating rod 121; wherein the first moving coil 205 is suspended for oscillating movement in the air gap 204.

Thus, the first moving coil moves with the vibration coil. The moving coil may be driven by an alternating current, AC. The moving coil and the vibrating rod perform a vibrating movement when an alternating current, AC, is applied to the coil. The alternating current may be caused by applying an electric calibration signal with a frequency sweep, also known as a chirp. In some aspects, the alternating current is caused by applying an electric signal including a voice signal. Thus, the electrodynamic vibrator and the vibrating rod interact electromagnetically to produce a magnetic force which induces a vibration at least at the ear portion of the manikin. The vibrating rod transfers vibration to the manikin.

In other aspects, the vibrating rod includes a permanent magnet or a coil with a direct current, DC, and the electrodynamic vibrator includes a coil driven by an alternating current, AC, e.g. including a test signal with a frequency sweep, chirp.

In some embodiments, the electrodynamic vibrator 120 is a loudspeaker 206 with a moving coil, a cone and a circumferential suspension member and wherein the vibrating rod has an elongated shape; wherein the vibrating rod 121 is attached by glue, at its one end, to the cone or the moving coil and, at its other end, abuts the manikin 120 or a part 106 thereof by a force exerted by magnetic coupling between the manikin and the vibrating rod 121.

It has surprisingly been observed that a conventional loudspeaker, e.g. a so-called 1" loudspeaker or e.g. a 2" loudspeaker serves well as to induce vibration of the manikin body at least at the ear portion. The loudspeaker is also denoted a loudspeaker driver. The vibrations are controlled in accordance with an electric signal applied to the loudspeaker to cause an alternating current in the coil of the loudspeaker.

In some aspects, the loudspeaker is a so-called exciter. An exciter functions like a loudspeaker driver, however the cone, membrane, is replaced by a rigid connection to a surface that will vibrate. The rigid connection may include the rigid connection and the surface may be the surface of the manikin or a part thereof.

In some embodiments, the apparatus comprises a closed chamber 207 accommodating the electrodynamic vibrator 120; 206 and having a fixture 208 for attachment of the manikin to the closed chamber.

Thereby the closed chamber serves as an acoustic isolator at least partially preventing acoustic waves generated by the electrodynamic vibrator from reaching the ear portion of the manikin while still serving as a base for the manikin. In some aspects, a gasket of a fibre material or resilient material such as rubber or silicone is arranged between the closed chamber and the manikin to prevent a leak of acoustic waves from the closed chamber and/or dampen undesired vibrations from the closed chamber itself.

In some aspects, the fixture for attachment of the manikin body to the chamber is configured as a bayonet coupling for engaging with a complementary bayonet coupling of the manikin.

In some aspects, the chamber accommodating the electrodynamic vibrator has a natural frequency (eigenfrequency) significantly lower than a natural frequency of the electrodynamic vibrator including the vibrating member. In some aspects, the volume of the chamber has a resonant frequency significantly lower than a natural frequency of the electrodynamic vibrator including the vibrating member.

In some aspects, the chamber predominantly has a cylinder shape. In some aspects, the cylinder-shaped chamber has a wall thickness larger than 15%, e.g. 20-25% of the radius of the cylinder. The chamber may be made from a plastics material.

In some embodiments, the apparatus comprises a closed chamber 207 accommodating the electrodynamic vibrator 110; 206; wherein the closed chamber 207 has an opening 209 through a wall 210 of the closed chamber, wherein the opening allows a clearance between the vibrating member 121 and the opening 209.

The clearance allows vibrational movement of the vibrating member and limits a leak of acoustic waves from the inside of the closed chamber to the outside and thus to the ear portion of the manikin. This is particularly advantageous in aspects wherein the electrodynamic vibrator is configured like a loudspeaker including a membrane, which may be subjected to vibration.

In some aspects the clearance is significantly smaller than a thickness of the wall of the chamber where the opening is located.

In some aspects, the closed chamber has an upper portion, which is covered by the manikin, e.g. a neck portion of the manikin, when attached to the chamber and wherein the opening is located at the upper portion. The opening allows vertical movement of the vibrating member.

In some aspects, the closed chamber is partly or fully filled with a dampening material.

In some embodiments, the apparatus the electrodynamic vibrator 120; 206 has a cone 211; wherein the closed chamber 207 has a first volume, V1, in front of the cone and a second volume, V2, behind the cone; and wherein one or both of the first volume, V1, and the second volume V2, is partly or fully filled with a dampening material 212.

The dampening material serves to suppress the acoustic volume (sound level) of sound emitted by the electrodynamic vibrator, such as a loudspeaker, to reduce an effect of sound waves interfering with measurement at the ear portion of the manikin. The cone is sometimes denoted a membrane.

In some embodiments, the electrodynamic vibrator 120; 206 and the vibrating rod 121 engages with the mouth simulator 104 to induce vibration of the manikin, at least at the ear portion 107, via the mouth simulator 104.

The mouth simulator advantageously vibrates, albeit to a smaller extent, by a loudspeaker of the mouth simulator and, then, additionally by the electrodynamic vibrator. This may improve fidelity of the sound at the ear portion caused by speech from the mouth simulator.

There is also provided:

A method comprising:

at a system including a signal processor, a microphone 311, 312 located at the ear portion of the manikin, and a manikin in accordance with any of the preceding claims:

generating a first signal, S1; wherein the first signal, S1, is input to the mouth simulator (104), causing the mouth simulator at the manikin 101 to emit an acoustic voice signal;

generating a second signal, S2; wherein the second signal, S2, is input to the electrodynamic vibrator 110; 206, causing the electrodynamic vibrator 110; 206 at the manikin body 101 to induce vibration at least at the ear portion 107; and acquiring a first measurement signal S3; S4 based on the microphone 311; 312.

An advantage of such a method is more realistic electroacoustic tests on devices under test, for example, on devices under test such as headsets, headphones, earphones, hearing instruments and active hearing protectors. In some aspects, the method is conducted for testing the device under test, wherein the device under test may embody or accommodate the microphone. In other aspects, the method is conducted for obtaining calibration values for the manikin and the electrodynamic vibrator for subsequently testing the device under test in accordance with the calibration values.

Testing the device under test may include computing a characteristic based on at least the measurement signal The method enables a more realistic simulation of sound propagation from the mouth simulator to the ear portion by deliberately inducing vibration of the manikin, at least at the ear portion, in addition to the acoustic waves propagated in the air surrounding the head portion from the mouth simulator, via a mouth opening to the outside of an ear at the ear portion. In particular, the induced vibration may mimic so-called bone conducted sounds known from a being's head.

In some aspects of calibration, the microphone is fixated to the ear simulator e.g. by being integrated therewith. The microphone may thus be arranged at an inner side of the manikin and allow a device under test to be arranged in the ear canal or at the ear or on the ear.

The first signal and the second signal may be aligned in time to have identical phase. The first signal and the second signal may have identical amplitude or different amplitude.

In some embodiments, the microphone 311 is accommodated in an electronic device 313 and the method comprises:

arranging the electronic device 313, including at least the microphone 311, in the ear 314 of the manikin, or at the ear 314 of the manikin, or on the ear 314 of the manikin;

wherein the signal S4 based on the microphone is acquired from the electronic device 313.

The electronic device may be a device under test e.g. selected from the group of: headsets, headphones, earphones, hearing instruments and active hearing protectors. The electronic device may include a resilient member to keep the electronic device fixated in an ear canal or it may include a cushion and a headband or fixating the electronic device on the ear of the manikin.

In some examples, the electronic device is a device serving as a reference for acquiring a signal for determining calibration values.

In some examples, the electronic device is included in an ear simulator accommodated in the manikin.

In some examples, the electronic device is a device under test e.g. a device configured with voice processing.

The first signal and the second signal may include a sweep from a first frequency to a second frequency, e.g. a so-called chirp. The first frequency may be about 50-200 Hz e.g. about 100 Hz. The second frequency may be about 1000-4000 Hz, e.g. about 1500 Hz.

In some embodiments, the first signal, S1, and the second signal, S2, comprises a first test signal (TS1); and the method comprises:

receiving the first measurement signal S3; S4;

determining first calibration values, CV1, based on determining one or both of: a difference between the first test signal, TS1, and the first measurement signal S3; S4 and a ratio between the first test signal and the first measurement signal; and storing the first calibration value, CV1.

Thereby, it is possible to obtain more accurate measurements. The first calibration values may be stored in a memory of a signal processor, on a computer-readable medium, e.g. including uploading to a server computer. The first calibration values may be retrieved e.g. to compensate a measured signal in accordance with the calibration values.

The difference between the first test signal and the first measurement signal is useful in particular when the test signal is applied both during calibration and during testing of the device under test.

The ratio between the first test signal and the first measurement signal is useful also when the test signal is a first test signal during calibration and is a second test signal during testing of the device under test. The ratio between the first test signal and the first measurement signal may be computed in a frequency domain representation of the first test signal and the first measurement signal e.g. for determining a transfer function of a filter. The filter represents a frequency dependent shaping of the vibration in dependence of a signal to the mouth simulator.

The frequency domain representation may be determined using Fast Fourier Transformation (FFT) or short-Time Fourier Transformation (STFT).

In some embodiments, the first signal, S1, input to the mouth simulator, includes a second test signal, TS2; and the method comprises:

generating the second signal, S2, input to the electrodynamic vibrator 120; 206 based on modifying the second test signal, TS2, in accordance with the first calibration values, CV1;

The calibration values may be time domain values or frequency domain values. In the case of time domain values, the calibration values must be temporally aligned, or synchronized, to the first signal. The first signal is preferably a chirp signal.

There is also provided:

A system including a signal processor and a manikin as set our above and configured to perform the method set out above.

The system may include an electronic amplifier and a signal processor; wherein the signal processor is coupled to receive a signal for the mouth simulator and to output a compensated signal to the amplifier e.g. in accordance with calibration values; and wherein the amplifier is coupled to the electrodynamic vibrator.

There is also provided:

A computer-readable medium encoded with instruction for performing the method set out above when run on a computer.

The computer-readable medium may be a Random Access Memory, RAM, or Read Only Memory, ROM. The computer-readable medium may be a solid state drive at a signal processor or at server computer.

BRIEF DESCRIPTION OF THE FIGURES

A more detailed description follows below with reference to the drawing, in which.

DETAILED DESCRIPTION

Figure 1:
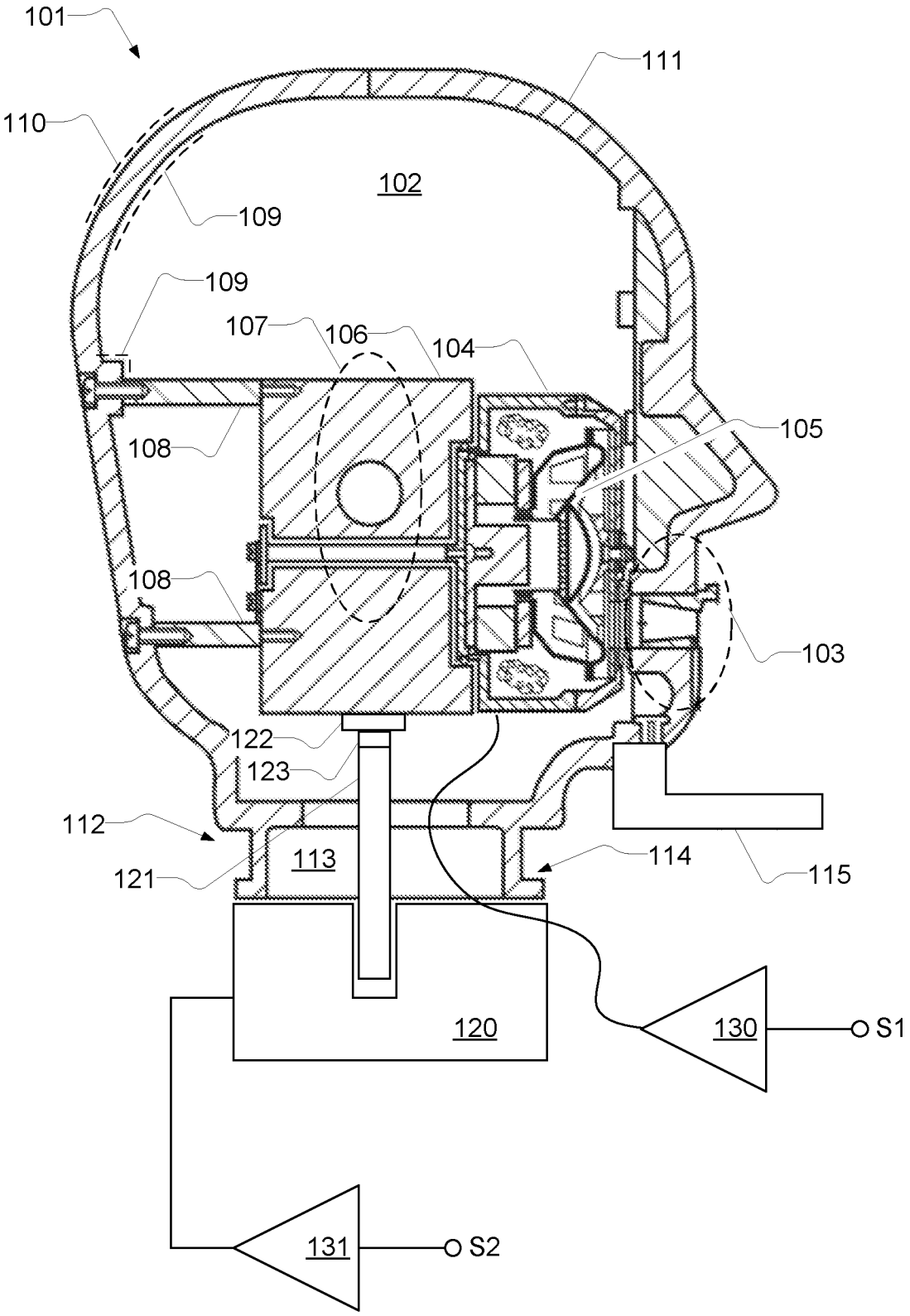
FIG. 1 shows a cross-section, in a sagittal plane, of a manikin and a vibrator.

FIG. 1 shows a cross-section, in a sagittal plane, of a manikin and a vibrator. The sagittal plane is also sometimes denoted a median plane. The manikin 101 includes at least a head portion 102 and an ear portion 107. The manikin 101 may be embodied, at least partially, by a shell construction 111. The head portion 102 has/have an inner side 109 and an outer side 110. The shell construction 111 may accommodate a mouth simulator 104 including an electroacoustic transducer 105, e.g. a loudspeaker driver. The shell construction 111 forms a space, which may be made from a plastics material or a resin material. The shell construction 111 may include a neck portion with a downward opening 113 and coupling means, e.g. a bayonet coupling 114, to connect with complementary coupling means, e.g. a complementary bayonet coupling. The shell construction may include fixtures 108, e.g. stays, for fixation of a mounting member 106. The mouth simulator may be fixated to the mounting member 106.

The shell construction may also include an ear simulator (see FIG. 3) including at least one microphone. The ear simulator is accommodated inside the manikin e.g. coupled to an ear member or ear portion of the manikin. The ear simulator may be fixated to one or both of the shell construction 111 and the mounting member 106. The ear portion 107 is here shown by a dashed line which illustrates a simplified projection onto the sagittal plane cross-section. The ear portion 107 is shown in greater detail in FIG. 3.

An electrodynamic vibrator 120 and a vibrating rod 121, coupled to the electrodynamic vibrator 120, is arranged to exert a vibrating force via the inner side 109 of the head portion 102. The vibrating rod 121 may be coupled to a member e.g. mounting member accommodated inside the head portion 102 and attached to the inner side 109 of the head portion 102 by fixtures 108. In some aspects, the vibrating rod 121 is coupled directly at the inner side 109 of the head portion 102 e.g. at an ear portion 107 on the inner side 109. In some aspects, the vibrating rod 121 is coupled to the head portion via a magnetic coupling or a mechanical coupling e.g. including a releasable coupling. Thus, the vibrating force induces vibration of the manikin at least at the ear portion 107. The vibrating force may include, predominantly, a vertical component. However, in some aspects, vibration force in two or more predominant directions is applied to the manikin by the vibrating rod being coupled or fixated to a mechanical arm or eccentrically coupled rotating member to induce vibration a vertical direction and in a horizontal direction, e.g. parallel to the sagittal plane and the coronal plane, respectively.

The electrodynamic vibrator 120 is driven by a signal S2 via an amplifier 131. The signal S2 may include a frequency sweep, e.g. a chirp signal, or a simulated voice signal. The mouth simulator 104 is driven by a signal S1 via an amplifier 130. In response to the signal S1, the mouth simulator 104, and in particular the electroacoustic transducer 105, emits an acoustic signal through a mouth opening 103 of the manikin 101.

The manikin also includes a detachable protrusion 115 e.g. for mounting a microphone.

In general, herein, it should be noted that the manikin may include a torso part or portion of the manikin. Also, the manikin may include a full body.

Figure 2:
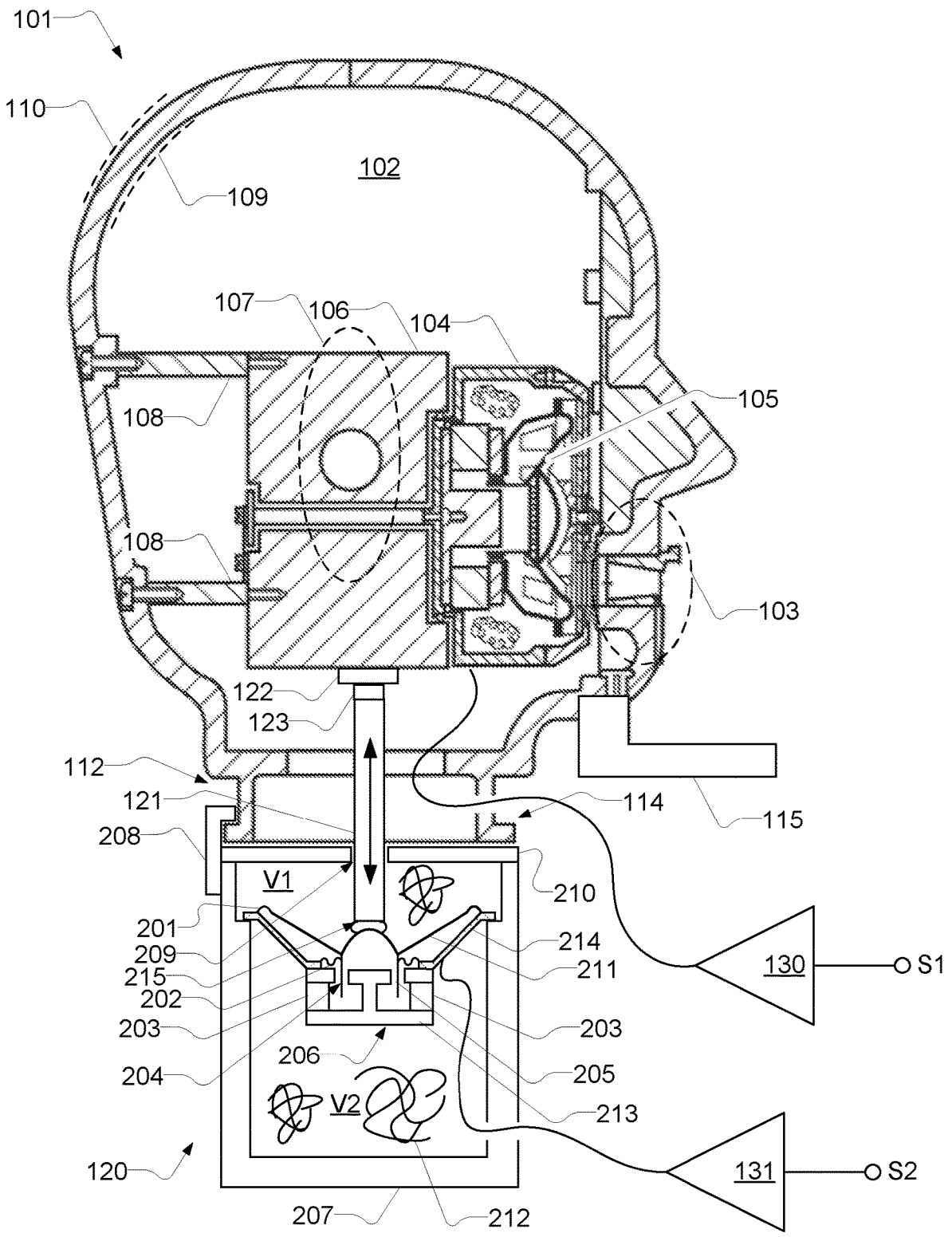
FIG. 2 shows a cross-section, in a sagittal plane, of a manikin and a vibrator shown in greater detail.

FIG. 2 shows a cross-section, in a sagittal plane, of a manikin and the vibrator shown in greater detail. The vibrator 120 is attached to the manikin 101 at the neck portion 112 e.g. via a bayonet coupling 114 and a complementary bayonet coupling 208. However, in some aspects the vibrator is attached to or fixated to the manikin by other means e.g. by strews or clamps or by a magnetic coupling with one or more magnets arranged along the periphery of the neck portion.

The vibrating rod 121 is coupled to the mounting member 106 via a metal or metallic disc 122 fixated, e.g. by glue or screws, to the mounting member 106. The vibrating rod 121 has a magnet 123, e.g. a neodymium magnet, fixated to or integrated with the vibrating rod 121. A neodymium magnet secures strong magnetic coupling which keeps the vibrating rod 121 and the mounting member 106 abutting at times when the vibrating rod is inducing vibrations, while keeping the mass of the vibrating rod relatively low.

The electrodynamic vibrator, shown in a cross-section, includes an electrodynamic driver 206, e.g. a loudspeaker driver, which is accommodated in a closed chamber 207. The electrodynamic driver 206 includes a permanent magnet 203 and a pole member 213 which establishes an air gap 204 in which a moving coil 205 can move in a vertical direction in response to the electric signal S2 applied via amplifier 131. The moving coil 205 is attached to a cone 211 which is attached, via a suspension 201, to frame 214. Also, a so-called spider 202 keeps the cone and the coil centred in the air gap. The electrodynamic driver 206 is, by and large, rotationally symmetric. The vibrating rod 121 is attached to the cone or the coil by glue 215.

In some aspects, the closed chamber 207 has a cylinder shape with a bottom portion and a top portion. The electrodynamic driver 206 is fixated at a distance from the top portion. The top portion includes a wall 210, e.g. a lid, e.g. detachable. The electrodynamic driver 206, particular the cone 211, the suspension 201 and the frame 214 divides the closed chamber into a first volume, V1, in front of the cone, and a second volume, V2, behind the cone. In some aspects, one or both of the first volume (V1) and the second volume (V2) is/are partly or fully filled with a dampening material (212). The dampening material reduces the volume of acoustic waves leaking form the closed chamber.

As can be seen, the closed chamber 207 has an opening 209 through a wall 210, e.g. a lid, of the closed chamber. The opening allows a clearance between the vibrating rod 121 and the opening 209. The opening 209 and the vibrating rod 121 generally have the same cross-sectional shape, e.g. a substantially circular shape at least at an axial portion of the vibrating rod, where the vibrating rod extends through the opening 209.

Figure 3:
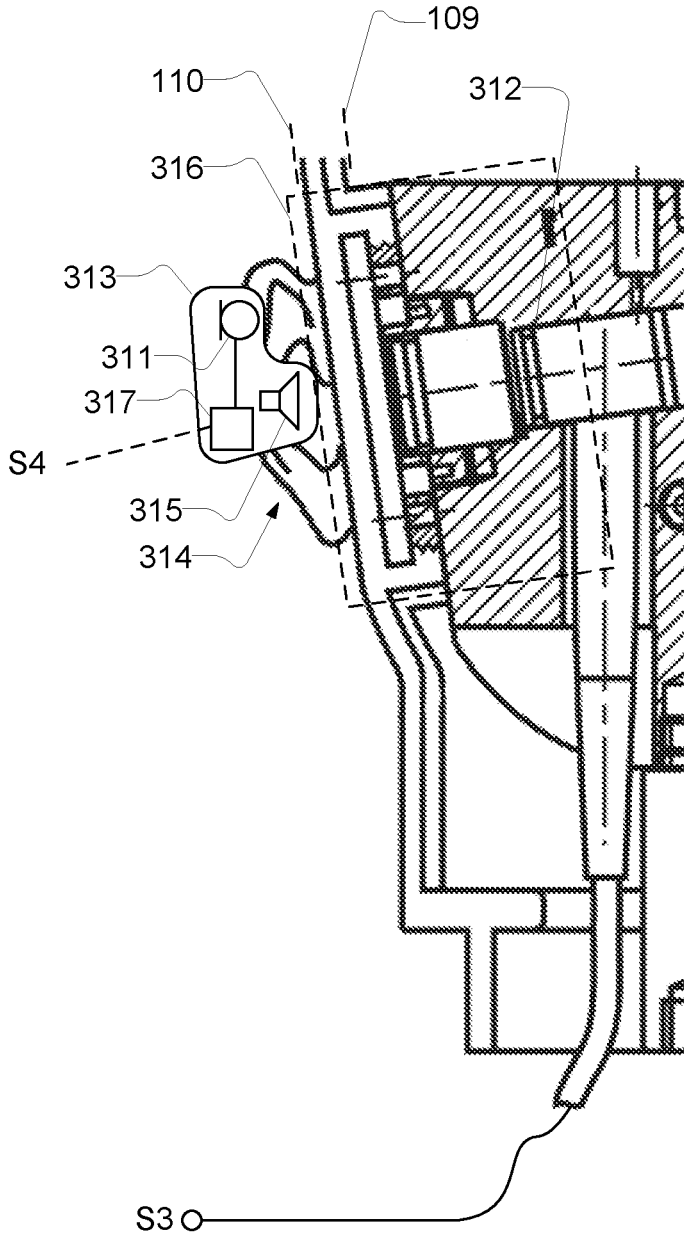
FIG. 3 shows a cross-section, in a coronal plane, of a portion of a manikin including a block diagram of an electronic device.

FIG. 3 shows a cross-section, in a coronal plane, of a portion of a manikin including a block diagram of an electronic device. The coronal plane may also be denoted a frontal plane. The portion may be a right hand side of a manikin head portion including the neck portion. It is shown that an ear simulator 316 is attached to the head portion 102 of the manikin 101. The ear simulator may include a detachable ear portion 314 resembling an ear. In some aspects, the ear simulator included a microphone 312, to generate a microphone signal S3 simulating acoustic signals in an ear canal of the ear portion 314.

Also shown is a block diagram of an electronic device 313 including a microphone 311, a small loudspeaker 315 and a signal processor 317 integrated in the electronic device 313. In some embodiments, the small loudspeaker 315 is not included in the electronic device 313.

The electronic device 313 may be a reference device for acquiring calibration values or it may be a device under test. As examples, one or both of the reference device and the device under test may be selected from the group of:

headsets, headphones, earphones, hearing instruments and active hearing protectors.

The electronic device 313 generates a microphone signal S4 or a processed microphone signal S4 for computing calibration values or for measuring performance of a device under test as the case may be. For the purpose of computing calibration values, one or both of the signals S3 and S4 may be acquired from the respective microphones. The microphone signal S4 or the processed microphone signal S4 may be transmitted to a signal processor via a wired or wireless link.

As explained above, the vibrating rod induces vibrations of the ear portion of the manikin. The ear portion may include one or both of: the (detachable) ear portion 314 resembling an ear and the ear simulator 316. In embodiments without a detachable ear portion or without an ear simulator, the ear portion of the manikin head may vibrate in accordance with the vibrations induced by the vibrating rod.

Figure 4:
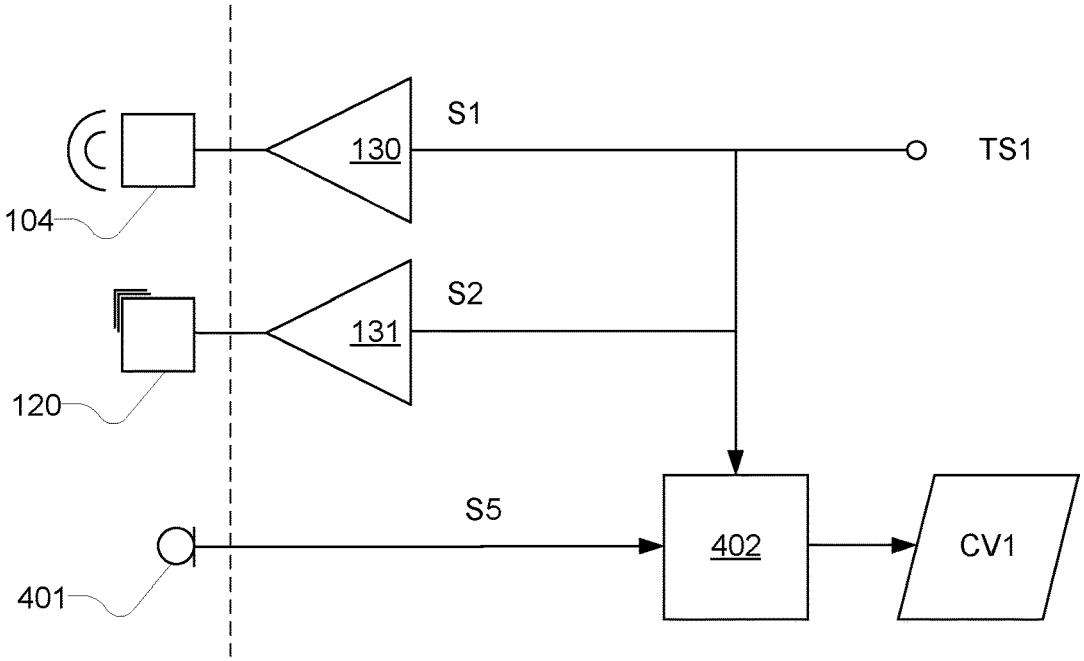
FIG. 4 shows a block diagram of a signal processor configured to measure calibration values.

FIG. 4 shows a block diagram of a signal processor configured to measure calibration values. At the manikin, the mouth simulator 104 generates an acoustic signal through the mouth opening at the manikin head in response to the signal S1 via the amplifier 130. Also, at the manikin, the electrodynamic vibrator 120 generates vibrations at least at the ear portion of the manikin head in response to the signal S2 via the amplifier 131.

At least for the purpose of acquiring calibration values, a test signal, TS1, is included in the signal S1 for the mouth simulator and in the signal S2 for the vibrator. The test signal, TS1, may include a frequency sweep, chirp, signal.

The chirp signal has a predetermined magnitude at predetermined points in time. The test signal, TS1, may alternatively, at least at a different time than the frequency sweep, include an artificial voice signal or another signal with a predetermined frequency distribution.

Concurrently therewith, a measurement signal, S5, is acquired from a microphone 401 at the manikin. The microphone 401 may be microphone 311 of a reference device 313 or it may be microphone 312 of an ear simulator 316.

In some aspects, a signal processing unit 402 computes first calibration values, CV1, based on determining a difference between the first test signal, TS1, and the first measurement signal S5. This is expedient e.g. when the first test signal, TS1, includes a frequency sweep, chirp, signal or another signal with a magnitude at predetermined points in time. The frequency sweep may include a sweep at discrete frequencies at which the difference is computed. The first calibration values may include gain values or a difference signal at the discrete frequencies at which the difference is computed.

In other aspects, the signal processing unit 402 computes the first calibration values, CV1, based on determining a ratio between the first test signal, TS1, and the first measurement signal S5. This is expedient e.g. when the first test signal, TS1, includes an artificial voice signal or another signal e.g. a signal with a predetermined frequency distribution. The first calibration values may include gain values at the discrete frequencies at which the difference is computed. The first calibration values may be coefficients of a calibration filter.

The first calibration values are stored for subsequent retrieval at least during measurements at a device under test.

Figure 5:
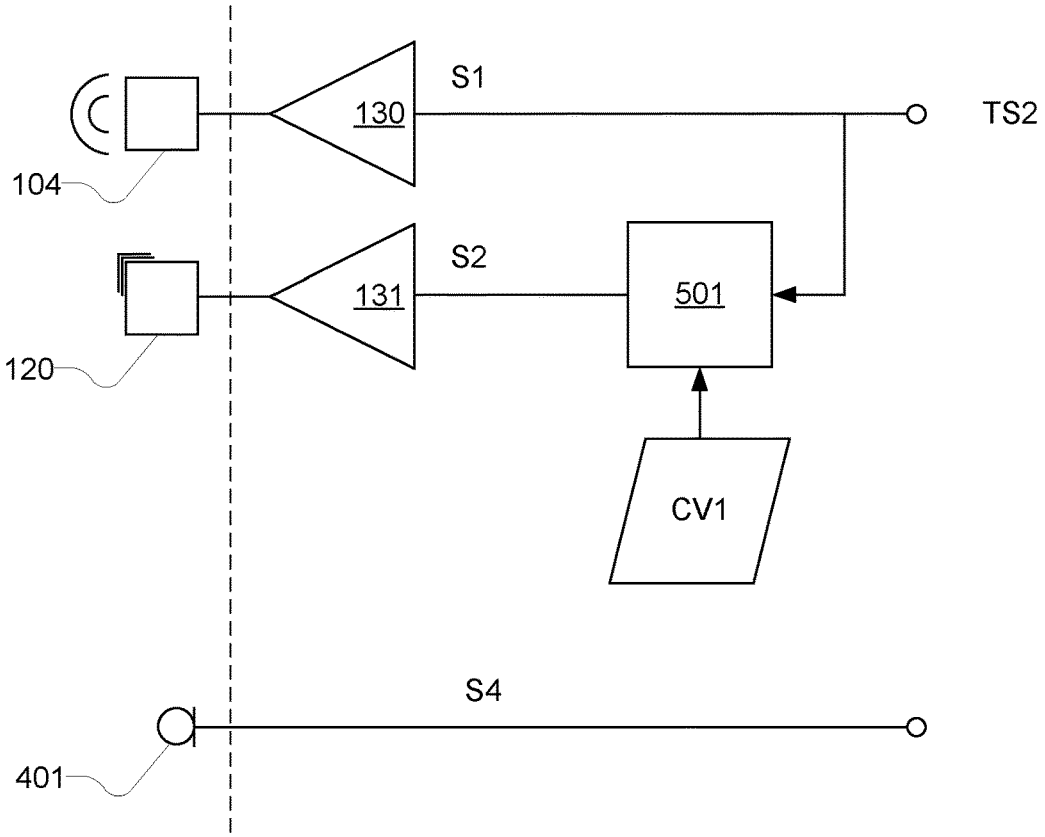
FIG. 5 shows a block diagram of a signal processor configured for driving the vibrator in accordance with calibration values.

FIG. 5 shows a block diagram of a signal processor configured for driving the vibrator in accordance with calibration values. During measurements on the device under test, the signal S4 is acquired as described above. Also, the signal, S1, and the signal, S2, are applied to the mouth simulator, 104, and to the vibrator 120, respectively. The signals, S1 and S2 include a second test signal TS2, however signal S2 is modified in accordance with the first calibration values by a signal processing unit 501. The signal processing unit 501 may include a summation unit or a multiplier unit. The signal processing unit 501 receives the second test signal TS2 and the calibration values CV1.

In some aspects, the calibration values CV1 are stored in a time domain representation e.g. including an array of magnitude values e.g. per sample unit. In some examples, the magnitude values are synchronized to the second test signal TS2. A summation unit included with the signal processing unit 501 may then generate the signal S2 by adding magnitude values of TS2 and magnitude values included in the calibration values 501. Calibration values CV1 and samples of the second test signal TS2 may be mutually associated per sample unit (sample time).

In other aspects, the calibration values CV1 are stored in a frequency domain representation e.g. including an array of magnitude values e.g. per frequency bin. A multiplier unit included with the signal processing unit 501 may then generate the signal S2 by multiplying magnitude values of TS2 and magnitude values included in the calibration values 501. Calibration values CV1 and samples of the second test signal TS2 may be mutually associated per frequency bin. In this respect, signal TS2 may be in a frequency domain representation e.g. a short time frequency domain. Signals 51 and S2 are time domain signals e.g. generated via an inverse fast Fourier transformation e.g. an inverse short time fast Fourier transformation.

As claimed herein, it is possible to obtain more accurate measurements and a more realistic acoustic representation of speech uttered by a human being including bone conducted vibrations.

Thus, there is provided an apparatus, comprising:

a manikin 101 with at least a head portion 102 and an ear portion 107; wherein the head portion has an inner side and an outer side and accommodates a mouth simulator 104 including an electroacoustic transducer 105, and an electrodynamic vibrator 120 and a vibrating rod 121 coupled to the electrodynamic vibrator 120; wherein the vibrating rod is coupled to the manikin 101 to exert a vibrating force via the inner side 109 of the head portion 102; wherein the vibrating force induces vibration of the manikin at least at the ear portion 107.

In some aspects, the vibrating rod 121 is coupled to the inner side 109 of the head portion 120 e.g. via fixtures 108.

There is also provided an apparatus, comprising a manikin 101 with at least a head portion 102 and an ear portion 202; wherein the head portion has a mouth simulator 103 including an electro-acoustic transducer 103; and wherein the head portion 102 has an ear portion 203, and further comprising a vibrator mechanically coupled to the manikin and configured to induce vibration of the manikin at least at the ear portion. In some aspects thereof, the electrodynamic vibrator 110 is a solid state vibrator. Further aspects thereof are described herein in connection with the detailed description and the figures and in the summary section.

The invention claimed is:

1. An apparatus, comprising:

a manikin with at least a head portion and an ear portion; wherein the head portion has an inner side and an outer side and accommodates a mouth simulator including an electroacoustic transducer, wherein further comprising:

an electrodynamic vibrator and a vibrating rod coupled to the electrodynamic vibrator;

wherein the vibrating rod is coupled to the manikin to exert a vibrating force at the head portion; wherein the vibrating force induces vibration of the manikin at least at the ear portion.

2. An apparatus according to claim 1, comprising a first member and a second member which are magnetic and/or magnetisable;

wherein the first member is fixated on a downwardly facing face of the manikin or a member attached to the manikin; and wherein the second member is fixated on a distal portion of the vibrating rod.

3. An apparatus according to claim 1, comprising a resilient suspension element; wherein the resilient suspension element enables a static axial movement of the vibrating rod to accommodate at least some static offset between the manikin and the electrodynamic vibrator.

4. An apparatus according to claim 1, wherein the electrodynamic vibrator comprises a first permanent magnet; an air gap and a first moving coil fixated to the vibrating rod; wherein the first moving coil is suspended for oscillating movement in the air gap.

5. An apparatus according to claim 1, wherein the electrodynamic vibrator is a loudspeaker with a moving coil, a cone and a circumferential suspension member and wherein the vibrating rod has an elongated shape; wherein the vibrating rod is attached by glue, at its one end, to the cone or the moving coil and, at its other end, abuts the manikin or a part thereof by a force exerted by magnetic coupling between the manikin and the vibrating rod.

6. An apparatus according to claim 1, comprising a closed chamber accommodating the electrodynamic vibrator and having a fixture for attachment of the manikin to the closed chamber.

7. An apparatus according to claim 1, comprising a closed chamber accommodating the electrodynamic vibrator; wherein the closed chamber has an opening through a wall of the closed chamber, wherein the opening allows a clearance between the vibrating member and the opening.

8. An apparatus according to claim 1, wherein the electrodynamic vibrator has a cone; wherein the closed chamber has a first volume in front of the cone and a second volume behind the cone; and wherein one or both of the first volume and the second volume is partly or fully filled with a dampening material.

9. An apparatus according to claim 1, wherein the electrodynamic vibrator and the vibrating rod engages with the mouth simulator to induce vibration of the manikin, at least at the ear portion, via the mouth simulator.

10. A method of operating the apparatus of claim 1 which further comprises a signal processor to control operations of the manikin and a microphone located at the ear portion of the manikin;

generating a first signal; wherein the first signal is input to the mouth simulator, causing the mouth simulator at the manikin to emit an acoustic voice signal;

generating a second signal; wherein the second signal is input to the electrodynamic vibrator, causing the electrodynamic vibrator at the manikin to induce vibration at least at the ear portion; and acquiring a first measurement signal based on the microphone.

11. A method according to claim 10, wherein the microphone is accommodated in an electronic device; comprising:

arranging the electronic device, including at least the microphone, in the ear of the manikin, or at the ear of the manikin, or on the ear of the manikin;

wherein the signal based on the microphone is acquired from the electronic device.

12. A method according to claim 10, wherein the first signal and the second signal comprises a first test signal; comprising:

receiving the first measurement signal;

determining first calibration values based on determining one or both of: a difference between the first test signal and the first measurement signal and a ratio between the first test signal and the first measurement signal; and storing the first calibration values.

13. A method according to claim 12, wherein the first signal, input to the mouth simulator, includes a second test signal; comprising:

generating the second signal, input to the electrodynamic vibrator based on modifying the second test signal in accordance with the first calibration values.

* * * * *